United States Patent [19]

Wiedemann et al.

[11] Patent Number: 4,762,760

[45] Date of Patent: Aug. 9, 1988

[54] ELECTROPHOTOGRAPHIC RECORDING MATERIAL COMPRISING A PYRAZOLINE DERIVATIVE

[75] Inventors: Wolfgang Wiedemann, Geisenheim-Johannisberg; Michael Drexler, Bischofsheim; Juergen Fuerderer, Mainz, all of Fed. Rep. of Germany

[73] Assignee: Hoechst Aktiengesellschaft, Fed. Rep. of Germany

[21] Appl. No.: 8,357

[22] Filed: Jan. 29, 1987

[30] Foreign Application Priority Data

Feb. 1, 1986 [DE] Fed. Rep. of Germany ..... 3603139

[51] Int. Cl.[4] ..... G03G 5/06; G03G 5/14

[52] U.S. Cl. ..... 430/59; 430/76; 430/78

[58] Field of Search ..... 430/58, 59, 76, 78

[56] References Cited

U.S. PATENT DOCUMENTS

| | | | |
|---|---|---|---|
| 3,180,729 | 4/1965 | Klupfel et al. | 96/1 |
| 3,837,851 | 9/1974 | Shattuck et al. | 96/1.5 |
| 3,973,959 | 8/1976 | Rochlitz et al. | 96/1.5 |
| 4,030,923 | 6/1977 | Krause et al. | 96/1.5 |
| 4,278,746 | 7/1981 | Goto et al. | 430/59 |
| 4,307,167 | 12/1981 | Bowden et al. | 430/58 |
| 4,315,982 | 2/1982 | Ishikawa et al. | 430/59 |
| 4,490,452 | 12/1984 | Champ et al. | 430/58 |
| 4,567,125 | 1/1986 | Moroni | 430/58 |
| 4,632,892 | 12/1986 | Yashiki et al. | 430/58 |

*Primary Examiner*—John L. Goodrow

*Attorney, Agent, or Firm*—Foley & Lardner, Schwartz, Jeffery, Schwaab, Mack, Blumenthal & Evans

[57] ABSTRACT

An electrophotographic recording material is comprised of an electrically conducting film base, an optional, adhesion-promoting, insulating intermediate film and at least one binder-containing photoconductive film that also contains a charge-carrier generating compound and pyrazoline charge-transporting compound represented by the formula (I)

in which n denotes zero or 1 and $R_1$, $R_2$, $R_3$, $R_4$ and $R_5$ respectively denote hydrogen or halogen, preferably chlorine or bromine.

Such a recording material has a low pre-exposure sensitivity combined with very good photosensitivity, and a low residual charge level in cyclic behavior. The charge-transporting compound has a low tendency to crystallize out in the film.

15 Claims, 4 Drawing Sheets

ELECTROPHOTOGRAPHIC RECORDING MATERIAL COMPRISING A PYRAZOLINE DERIVATIVE

BACKGROUND OF THE INVENTION

The present invention relates to an electrophotographic recording material comprising an electrically conducting film base; an optional, adhesion-promoting, insulating intermediate layer; and at least one binder-containing photoconductive film which also contains a charge-carrier generating compound and a pyrazoline derivative as a charge-transporting compound. The present invention relates particularly to a recording material in which the photoconductive film is comprised of a charge-carrier generating and charge-transport film.

The use as photoconductors of 1,3,5-triphenylpyrazoline derivatives and 1,5-diphenyl-3-styrylpyrazoline derivatives is known. Thus, in German Pat. No. 1,060,714 (corresponding to U.S. Pat. No. 3,180,729) these compounds are described in a monolayer arrangement that is characterized by homogeneous dyestuff sensitization achieved, for example, by addition of rhodamines, and that especially contains alkalinely decoatable binders. This results, however, in photoconductive films with low photosensitivity unsuitable for copying purposes.

German Pat. No. 2,220,408 (corresponding to U.S. Pat. No. 3,973,959) discloses the use of pyrazoline derivatives as charge-transport compounds in photoconductive films.

The application of 1,5-diphenyl-3-styrylpyrazoline derivatives which have electron-donating substituents such as methoxy, ethoxy, dimethylamino and diethylamino groups in the p-position of the 3-styryl and 5-phenyl group is further known from U.S. Pat. No. 3,837,851, No. 4,030,923, No. 4,307,167 and No. 4,490,452. 1-phenyl-3-[p-diethylaminostyryl)-5-(p-diethylaminophenyl)]pyrazoline is perferably used in transport films.

In addition, similar pyrazoline derivatives in photoconductive films are known from U.S. Pat. No. 4,278,746. Analogous compounds are also described in U.S. Pat. No. 4,315,982.

A disadvantage of the known pyrazoline derivatives is, in some cases, their poor yield during manufacture and their difficult preparation, involving several reaction stages.

In German Pat. No. 3,246,036 (corresponding to U.S. Pat. No. 4,567,125), 1,5-diphenyl-3-p-methoxyphenylpyrazoline and 1-phenyl-3-p-methylstyryl-5-p-tolylpyrazoline are described in charge-transport films. The latter compound tends to crystalline out after film formation and, in addition, its adhesion and photosensitivity are still not very satisfactory.

SUMMARY OF THE INVENTION

It is therefore an object of the present invention to provide a highly photosensitive electrophotographic recording material comprised of pyrazoline photoconductor compounds that are readily prepared, which material displays high flexibility yet adheres very well and has a very low pre-exposure sensitivity.

In accomplishing the foregoing object, there has been provided, in accordance with one aspect of the present invention, an electrophotographic recording material comprised of an electrically conducting film base and at least one photoconductive film provided on the film base, the photoconductive film comprising a binder, a charge-carrier generating compound and a pyrazoline charge-transporting compound represented by the formula

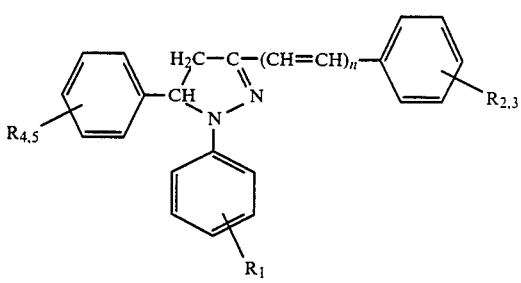

(I)

where n denotes zero or 1 and $R_1$, $R_2$, $R_3$, $R_4$ and $R_5$ respectively denote hydrogen or halogen. In a preferred embodiment, the R-groups in formula (I) respectively denote hydrogen, chlorine or bromine.

Other objects, features and advantages of the present invention will become apparent from the following detailed description. It should be understood, however, that the detailed description and specific examples, while indicating preferred embodiments of the invention, are given by way of illustration only, since various changes and modifications within the spirit and scope of the invention will become apparent to those skilled in the art from this detailed description.

DETAILED DESCRIPTION OF THE PREFERRED EMBODIMENTS

Figure 1:
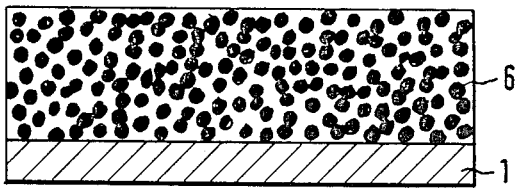
FIGS. 1–4 are schematic drawings showing, in cross section, different recording materials of the present invention.
Figure 2:
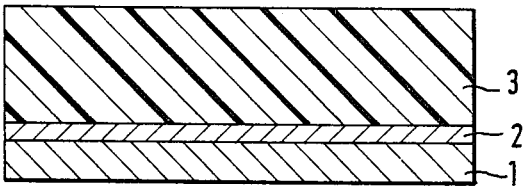
Figure 3:
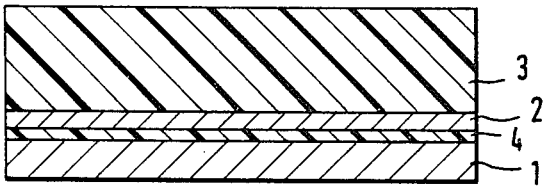

For n=zero, the compounds of formula I which, like 1,3-diphenyl-5-(2-chlorophenyl)pyrazoline and 1,3-diphenyl-5-(2,4-dichlorophenyl)-pyrazoline, have $R_1$ and $R_{2,3}$ that denote hydrogen and $R_4$ or $R_5$ that denotes halogen, chlorine and bromine being preferred, have proved suitable.

Of the styrylpyrazoline derivatives in which n=1, compounds are preferably used in which $R_1$ denotes hydrogen and $R_{2,3}$ and $R_{4,5}$ denote halogen. Especially favorable are compounds, such as 1-phenyl-3-(2-chlorostyryl)-5-(2-chlorophenyl)pyrazoline and 1-phenyl-3-(2,4-dichlorostyryl)-5-(2,4-dichlorophenyl)-pyrazoline, that have a halogen, in particular a chlorine substituent, in the orthoposition. The charge-transporting compounds of formula I can also be halogen-substituted, at the 1-position, in the phenyl substituents.

The preparation of compounds that can be used according to the present invention is generally known and is carried out analogously to the description given in German Pat. No. 1,060,714 (corresponding to U.S. Pat. No. 3,180,729). Preparationally, the compounds are very readily accessible by condensing benzalacetophenone derivatives or dibenzeneacetone derivatives, which are preferably Cl- and/or Br-substituted, with phenylhydrazines in acetic acid (99%–100%). Furthermore, the starting materials are cheap and the compounds can be prepared with high yield.

In addition to their photoconductive properties, the novel pyrazoline derivatives of the present invention are unusually highly fluorescent ($\lambda_{FL} \sim 500$ nm). They can therefore also be used as fluorescent dyestuffs, as "laser dyes", and as optical brighteners, for example, for PVC plastic materials.

The novel charge-transport compounds of formula I exhibit very good film formation with various binders and an unusually low tendency to crystallize out, even at relatively high concentrations. At the same time, the films remain flexible and have very good adhesion, even in a double film system.

A surprising feature of double films containing the above-described charge-transporting compounds is a very low pre-exposure sensitivity and a very high photosensitivity. At the same time, a number of pigments can be used in charge-generating films of recording material within the present invention. Particularly suitable for this purpose are condensation products of perylene-3,4,9,10-tetracarboxylic acid dianhydride with akylamines, arylamines, aralkylamines and o-aryldiamines, as indicated in the accompanying Formula Table II.

Furthermore, a markedly improved residual discharge behavior of the films, particularly with styrylpyrazoline derivatives (e.g., Formulas 5 and 6), proves to be advantageous. By adding certain electron-acceptor compounds like 9-bromoanthracene, the level and constancy of the residual discharge can be improved still further, especially in terms of cyclic behavior. In this connection, the activatability of the charge-transporting compounds with halogenated anthracene derivatives or acridine derivatives in the 9- or 10-position is especially advantageous. The novel recording material of the present invention is suitable for a lithographic printing plate which can be manufactured by electrophotographic means, or for a printed circuit when the recording material comprises a correspondingly suitable, electrically conducting film base and a photoconductive film containing alkaline-decoatable binders.

The structure of electrophotographic recording material within the present invention is depicted in FIGS. 1–4. In each case, reference numeral 1 indicates the electrically conducting film base, reference numeral 2 indicates the charge-carrier generating film, and reference numeral 3 indicates the charge-transporting film. Reference numeral 4 designates an adhesion-promoting, insulating intermediate layer, while reference numeral 5 indicates a charge-carrier generating film containing pigment which can be dispersed, for example, in a binder. Reference numeral 6 designates a photoconductive monolayer comprised of dispersely distributed pigment, photoconductor and binder. This arrangement in FIG. 1 is advantageous for the preparation of printing plates by electrophotographic means.

Aluminum foil, if necessary transparent polyester film which is aluminum clad or coated with aluminum by vapor deposition or sputtering, can be used as the electrically conducting film base, but any other sufficiently conductive carrier material can also be used. The photoconductive system can also be arranged on a drum, on flexible endless belts, for example, of nickel, steel or the like, or on plates comprised, for example, of aluminum.

As film base for the electrophotographic preparation of printing plates or printed circuits, all the materials known for this purpose may be used, such as aluminum, zinc, magnesium and copper plates or multimetal plates. Surface-finished aluminum foils have proved especially successful. The surface finishing involves a mechanical or electrochemical roughening up and a subsequent optional anodizing and treatment with polyvinylphosphonic acid.

The introduction of an adhesion-promoting, insulating intermediate layer, if necessary also a thermally, anodically or chemically generated aluminum oxide intermediate layer (see FIG. 3, reference numeral 4), has the objective of reducing the charge-carrier injection from metal into the photoconductive film in the dark. On the other hand, it should not prevent charge flow during the exposure process. The intermediate layer acts as a barrier layer, serves to improve adhesion between the film-base surface and the pigment film and/or photoconductive film, and should be decoatable with water or alcoholic alkali.

Various natural or synthetic resin binders can be used for the intermediate layer, but those materials are preferred that adhere well to a metal surface, especially to an aluminum surface, and that undergo little dissolution when further films are subsequently added. These include polyamide resins, polyvinyl alcohols, polyvinylphosphonic acid, polyurethanes, polyester resins, polycarbonates, phenoxy resins, cellulose nitrates, vinyl chloride/vinyl acetate copolymers, and copolymers of styrene and butadiene, (meth-)acrylic acid esters and maleic acid anhydride.

Those binders, such as polycarbonates, polyester resins and, especially, vinyl chloride/vinyl acetate copolymers, that are also present in the charge-transport film have proved especially successful.

The thickness of the organic intermediate layers can be up to 5 μm, and that of an aluminum-oxide intermediate layer is generally in the range from 0.01 to 1 μm. Preferably, organic intermediate layers are also applied in the aforesaid thickness range.

Films 2 and 5 (FIGS. 2 to 4) have the function of a charge-carrier generating film; the pigment used in this connection determines, by its absorption behavior, the spectral photosensitivity of the photoconductive system.

The following pigments may advantageously be used:

perylene-3,4,9,10-tetracarboxylic acid dianhydride and diimide derivates thereof (for example, Formula Table II, A–C); bisbenzimidazole pigments such as cis- and trans-perinones (for example, formulae E, F); perylene-3,4,9,10-tetracarboxylic acid benzimidazole derivatives (for example, formula D); quinacridone and dioxazine derivative; polynuclear quinones, for example 4,10-dibromoanthanthrone (formula G, C.I. 59,300); flavanthrone etc., indigo and also thioindigo pigments; benzothioxanthene derivatives according to German Offenlegungsschrift No. 2,328,727 (for example, formula H); phthalocyanines (metal-containing, C.I. 74,160 and metal-free, C.I. 74,250), for example ε-copper phthalocyanine etc.; mono-, bis- and triazo pigments; and squarilium dyestuffs.

The application of a homogeneous, densely-packed pigment film is preferably achieved by vapor deposition of the pigment on the film base in vacuo. Depending on the vacuum level, the dyestuff can be deposited by evaporation without decomposing under the conditions of $1.33\times10^{-6}$ to $10^{-8}$ bar and a heating temperature of 240° to 290° C. At the same time, the temperature of the film base is below 50° C. As a result of this, films containing densely packed dyestuff molecules are obtained. This is advantageous compared with all other possibilities for generating very thin homogeneous films, it being possible thereby to obtain an optimum charge-generation rate in the pigment film.

The extremely finely dispersed distribution of the pigment makes it possible to obtain a high concentration of activated dyestuff molecules which inject charges into the transport film. In addition, the charge transport through the pigment film is not impeded, or is only slightly impeded, by binders.

An advantageous film-thickness range for the vapor-deposited pigment is between 0.005 and 3 μm. Particularly preferred is a thickness range between 0.05 and 1.5 μm, since in this case the adhesive strength and the homogeneity of the vapor-deposited pigment is particularly favorable.

Apart from vapor deposition of the pigment, a uniform pigment thickness can also be achieved by other coating techniques. These include application by mechanically rubbing the superfinely powdered material into the electrically conducting film base, by electrolytic or electrochemical processes, and by an electrostatic spraying technique.

Figure 4:
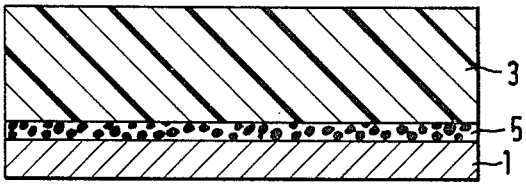

Pigment films having good coverage and thicknesses on the order of 0.05 to 3 μm may also be prepared by grinding the pigment together with binders, in particular with cellulose nitrates, epoxy resins, PVC/PVAC copolymers, styrene/maleic acid anhydride copolymers, polymethacrylates, polyvinyl acetates, polyurethanes, polyvinylbutyrals, polycarbonates and polyesters etc., also mixtures thereof, and subsequently coating the dispersions in accordance with reference numeral 5 in FIG. 4. In addition, thermally postcuring binder systems such as reactive resins (DD lacquers) may be used.

The pigment/binder ratio may vary within wide limits, but pigment primer coatings are preferred that have a pigment proportion of over 50% and a correspondingly high optical density.

The charge-transporting film 3, which contains the novel charge-transport compounds, is preferably transparent and, without the pigment film, has virtually no photosensitivity in the visible region (450 to 750 nm). It consists of a mixture of an electron-donor compound (organic photoconductor) and a binder. Film 3 has a high electrical resistance of more than $10^{12}\Omega$. In the dark, film 3 prevents the preferably negative electrostatic charge from draining away; on exposure, it transports the charges generated in the pigment film.

The mixing ratio of the charge-transporting compound to the binder may vary. However, relatively definite limits are set by the requirement for maximum photosensitivity, i.e., the largest possible proportion of charge-transporting compounds, and for avoiding crystallizing out and increasing flexibility, i.e. the largest possible proportion of binders. Generally, a mixing ration of about 1:1 parts by weight has proved to be preferable, but ratios between 4:1 to 1:4 are also suitable. The surprisingly low tendency to crystalline out, which characterizes a number of the novel charge-transport compounds, makes possible the use of organic photoconductor/binder ratios of 4:1, particularly in combination with polycarbonate, without crystallizing out occurring and without the film-forming properties deteriorating.

It has also been discovered that the residual discharge properties of these highly sensitive photoconductive systems can be improved by adding electron-acceptor compounds. In the photoconductive system, the acceptors produce a reduction in the residual discharge and also an improved constancy of the cyclic parameters without impairment of the other good electrophotographic properties, such as photosensitivity, charge acceptance, dark decay, preexposure sensitivity, etc. They are preferably contained in the charge-transport film in a quantity of up to 10% by weight, relative to the total coating.

As an electron-acceptor compound, the photoconductive system can use an anthracene or acridine, substituted in the 9- and/or 10-position, of the following structure:

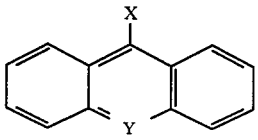

in which X denotes hydrogen, halogen, such as chlorine, bromine, iodine, the cyano group and Y denotes nitrogen or the grouping C–Z with Z denoting halogen, such as chlorine or bromine, or the cyano group.

Compounds which can be used by preference are 9,10-dibromoanthracene, 9,10-dichloroanthracene, 9-chloroanthracene, 9-bromoanthracene and 9-chloroacridine.

Advantageous charge-transport films are composed of about 50–70% by weight of charge-transport compound, 20–40% by weight of polycarbonate, approximately 10% by weight of vinyl chloride/vinyl acetate copolymer, and up to 6% by weight of electron-acceptor compound. Within these ranges, an optimum copy quality is achieved even at higher temperatures and humidities. In addition, the preexposure sensitivity is surprisingly low.

In addition to the charge-generating and charge-transport materials described, the binder added affects both the mechanical properties such as abrasion, flexibility, film formation and adhesion, and also, to a certain extent, electrophotographic properties such as photosensitivity, residual charge and cyclic behavior under normal conditions and at higher values for temperature (20° to 50° C.) and humidity (greater than 80% relative humidity).

Polyester resins, polyvinyl acetates, polycarbonates, silicone resins, polyurethanes, epoxy resins, phenoxy resins, poly(meth)acrylate and copolymers (for example, with styrene), polystyrene and styrene copolymers (for example, butadiene) and cellulose derivatives, such as cellulose acetobutyrates, can be used as binders. The photoconductive film preferably contains polyester resins, vinyl chloride/vinyl acetate copolymers, polycarbonates or mixtures thereof.

For the preparation of printing plates or printed circuits, the photoconductive film contains an alkalinely decoatable binder. Styrene/maleic acid anhydride copolymers, sulfonylurethanes, phenol resins or copolymers of vinyl acetate with an unsaturated carbonic acid are preferably used as alkalinely decoatable resins.

Thermally-postcuring binder systems such as reactive resins, which are composed of an equivalent mixture of polyesters or polyethers containing hydroxyl groups and polyfunctional isocyanates, polyisocyanate curable acrylate resins, melamine resins, unsaturated polyester resins and the like, have been applied successfully. Polyvinyl chloride, copolymers of vinyl chloride and vinyl acetate, polyvinylidene chloride, polyacrylonitrile and cellulose nitrate can also be used, particularly blended with the above-mentioned binders. A proportion of up to about 10% by weight, relative to the solids proportion of the charge-transport film, has proved advantageous in this connection.

Film thickness is also important for the optimum photosensitivity of the charge-transport film: film thicknesses between about 2 and 25 μm are generally used. A thickness range of 5 to 18 μm has proved to be advantageous. If mechanical requirements and the electrophotographic parameters of charging-up, exposure and development processes permit it, however, the specified limits can be extended upwards or downwards from case to case.

Conventional additives that can be employed in the present invention include flow-control agents such as silicone oils; wetting agents, in particular nonionogenic substances; and plasticizers of various composition, for example, those based on chlorinated hydrocarbons and those based on phthalic acid esters.

The present invention is described in more detail by reference to the following examples, which are illustrative only.

EXAMPLE 1

A polyester film coated with aluminum by vapor deposition (Al/PET film), to be used as an electrically conducting film base, was very thinly precoated (film weight below 100 mg/m$^2$) with a solution of vinyl chloride/vinyl acetate copolymer (Hostaflex M 131; manufactured by Hoechst AG), and N,N'-dimethylperylimide (A in Formula Table II) was vapor-deposited thereon in vacuo ($1.33\times10^{-7}-10^{-8}$ bar) in a temperature range of about 290° C. under mild conditions. The thickness of the resulting pigment film was about 140 mg/m$^2$. A tetrahydrofuran (THF) solution containing equal parts of polycarbonate (Makrolon 3200; manufactured by Hoechst AG) and the following pyrazoline derivatives:

(1) 1,3-diphenyl-5-(2-chlorophenyl)pyrazoline (formula 1 in Formula Table I)
(2) 1,3-diphenyl-5-(4-chlorophenyl)pyrazoline (formula 3), and also
(3) 1,3-diphenyl-5-(2,4-dichlorophenyl)pyrazoline (formula 4)

was applied to this charge-carrier generation film to a dry-film thickness of 9 to 10 μm.

As a comparison, a film containing the charge-transport compound 2,5-bis(4-diethylaminophenyl)-1-oxa-3,4-diazole (TO) was prepared in the same way.

The photosensitivity of these photoconductive double films was measured as follows (halogen/tungsten lamp, illumination intensity approximately 3.5 μW/cm$^2$):

To determine the bright discharge curves, the sample was moved through a charge device to the exposure station, where it was continuously illuminated with a halogen/tungsten lamp (150 W). Heat absorption glass and a neutral filter were placed in front of the lamp. The light intensity in the measurement plane was in the range from 3 to 10 μW/cm$^2$; it was measured with an optometer in parallel with the measurement operation. The charge level and photoinduced brightness decay curve were recorded, with an oscillograph, by means of a transparent probe using an electrometer. The photoconductive film was characterized by an initial charge level ($U_o$) and the time (t) required to reach half, one quarter and one eighth of charge level $U_o$. The product of a particular t [seconds] and the light intensity [μW/cm$^2$] measured in parallel yields the characteristic energy quantities [μJ/cm$^2$], such as the half-value energy $E_{\frac{1}{2}}$. The energy quantities at which $\frac{1}{8}$ of the initial charge ($U_o$) is reached serve to characterize the residual discharge characteristic of a photoconductive film. The residual charge $U_E$, predominantly measured after 1 or 3 sec, is also a measure of the residual discharge characteristics.

| Photoconductor layer | $(-)U_o$/V | $E_{\frac{1}{2}}$ | $E_{\frac{1}{8}}$ | $(-)U_E$/V (after 3 sec) |
|---|---|---|---|---|
| 1 | 480 | 0.99 | 2.8 | 27 |
| 2 | 500 | 1.04 | 3.9 | 39 |
| 3 | 520 | 0.96 | 2.9 | 31 |
| 4 | 490 | 1.36 | 8.93 | 51 |

EXAMPLE 2

As in Example 1, N,N'-dimethylperylimide (formula A) was vapor-deposited onto an Al/PET film precoated with polycarbonate.

THF solutions containing equal parts by weight of polyester resin (Dynapol L 206; manufactured by Hoechst AG) and (1) 1,3-diphenyl-5-(2-bromophenyl)pyrazoline (formula 1),
(2) 1,3-diphenyl-5-(2-fluorophenyl)pyrazoline (formula 1),
(3) 1,3-diphenyl-5-(2-chlorophenyl)pyrazoline (formula 1),
(4) 1,3-diphenyl-5-(3-chlorophenyl)pyrazoline (formula 2), and
(5) 1,3-diphenyl-5-(4-chlorophenyl)pyrazoline (formula 3) were applied thereto, respectively, in a thickness of about 10 μm after drying.

The measurement of the photosensitivity were carried out as in Example 1 (halogen/tungsten lamp, illumination intensity 3.5–3.8 μW/cm$^2$):

| Photoconductor layer | $(-)U_o$/V | $E_{\frac{1}{2}}$ | $E_{\frac{1}{8}}$ | $(-)U_E$/V (after 3 sec) |
|---|---|---|---|---|
| 1 | 560 | 1.11 | 3.31 | 23 |
| 2 | 500 | 1.13 | 3.27 | 23 |
| 3 | 500 | 1.06 | 3.14 | 15 |
| 4 | 470 | 1.11 | 3.65 | 23 |
| 5 | 510 | 1.08 | 3.18 | 15 |

EXAMPLE 3

THF solutions containing equal parts of polycarbonate and (1) 1-phenyl-3-(2-chlorostyryl)-5-(2-chlorophenyl)-pyrazoline (formula 5), (2) 1-phenyl-(2,4-dichlorostyryl)-5-(2,4-dichlorophenyl)pyrazoline (formula 6), (3) 1,5-diphenyl-3-styrylpyrazoline, (4) 1-phenyl-3-(4-methylstyryl)-5-(4-tolyl)pyrazoline and (5) 1,5-diphenyl-3-(4-methoxyphenyl)pyrazoline were coated onto a charge-carrier generating film as described in Example 2, and then were dried in a circulating-air drying oven at 90°–100° C.

Other transport films comprised of 50 parts by weight of charge-transport compound formulas 1–5, 47 parts by weight of polycarbonate and 3 parts by weight of 9-bromoanthracene (MBA) were likewise deposited, respectively, onto the pigment film.

The photoconductive double films having a thickness of approximately 10 μm were measured as in Example 1 (illumination intensity 4.3–5.0 μW/cm²):

| Photoconductor layer | Acceptor additive | $(-)U_o/V$ | $E_{\frac{1}{2}}$ | $E_{\frac{1}{8}}$ | $(-)U_E/V$ (after 3 sec) |
|---|---|---|---|---|---|
| 1 | — | 500 | 1.02 | 2.85 | 19 |
| 2 | — | 520 | 1.07 | 2.93 | 15 |
| 3 | — | 490 | 1.19 | 3.6 | 27 |
| 4 | — | 500 | 1.44 | 4.22 | 19 |
| 5 | — | 485 | 1.65 | 6.15 | 35 |
| 1' | MBA | 530 | 0.82 | 2.15 | 11 |
| 2' | MBA | 505 | 0.85 | 2.23 | 15 |
| 3' | MBA | 480 | 1.08 | 2.91 | 23 |
| 4' | MBA | 485 | 1.3 | 3.83 | 23 |
| 5' | MBA | 480 | 1.26 | 3.54 | 17 |

The photoconductive films containing the charge-transport compounds 4 and 5 were used for comparison purposes.

EXAMPLE 4

N,N'-dimethylperylimide (formula A) was continuously vapor-deposited in vacuo onto a conductive film base precoated with polycarbonate, so that the pigment film thickness was about 130 mg/cm². Solutions of the following charge-transport films were deposited thereon:

(a) 50 parts by weight of formula 5, 47 parts by weight of polycarbonate (Makrolon 3200) and 3 parts by weight of MBA; and (b) 50 parts by weight of formula 5, 47 parts by weight of vinyl chloride/vinyl acetate copolymer (Hostaflex M 131) and 3 parts by weight of MBA.

The following photosensitivities were measured as in Example 1 (halogen/tungsten lamp, illumination intensity approximately 3.5 μW/cm²):

| Photoconductor layer | Film weight g/cm² | $(-)U_o/V$ | $E_{\frac{1}{2}}$ | $E_{\frac{1}{8}}$ | $(-)U_E/V$ (after 3 sec) | Notes |
|---|---|---|---|---|---|---|
| a | 12.0 | 550 | 0.85 | 2.15 | 11 | Cyclic |
| a | | 480 | 0.85 | 2.11 | 11 | behavior |
| | | 510 | 0.87 | 2.23 | 19 | 1st measurement |
| | | | | | | 5th measurement |
| a | | 525 | 0.86 | 2.13 | 11 | Pre-exp. |
| | | 490 | 0.84 | 2.09 | 11 | sens. after $10^4$ lx in 1' |
| b | 12.6 | 540 | 1.01 | 2.53 | 3 | 1st measurement |
| b | | 490 | 0.97 | 2.47 | 3 | |
| | | 480 | 1.0 | 2.66 | 3 | 5th measurement |

-continued

| Photoconductor layer | Film weight g/cm² | $(-)U_o/V$ | $E_{\frac{1}{2}}$ | $E_{\frac{1}{8}}$ | $(-)U_E/V$ (after 3 sec) | Notes |
|---|---|---|---|---|---|---|
| b | | 500 | 1.04 | 2.8 | 3 | Pre-exp. |
| | | 490 | 0.98 | 2.41 | 0 | sens. after $10^4$ lx in 1' |

In addition, the cyclic behavior in the described measurement system could be determined by measuring the 1st, 5th and, optionally, additional bright discharges.

The pre-exposure sensitivity (pre-exp. sens.) was determined by measuring the bright discharge at the beginning; illumination of the photoconductor layer was carried out under a fluorescent lamp tube emitting about $10^4$ lux per minute, and illumination was followed by an equally long storage time in the dark. The bright discharge measurement then followed.

As is shown in the table, the change in electrophotographic data of these photoconductive films was very small under the specified conditions.

The spectral photosensitivity of the double films prepared was determined by the method specified in Example 1, with filters being inserted. With negative charging (500–550 V), the half-value time ($t_{\frac{1}{2}}$ in msec) was determined by illumination for the wavelength range concerned. By plotting the reciprocal half-value energy $1/E_{\frac{1}{2}}$ (cm²/μJ) against the wavelength λ(nm), the spectral photosensitivity curve was obtained. (In this connection, the half-wave energy $E_{\frac{1}{2}}$ (μJ/cm²) denotes the light energy that has to be injected to discharge the film to half the initial voltage $U_o$.)

Figure 5:
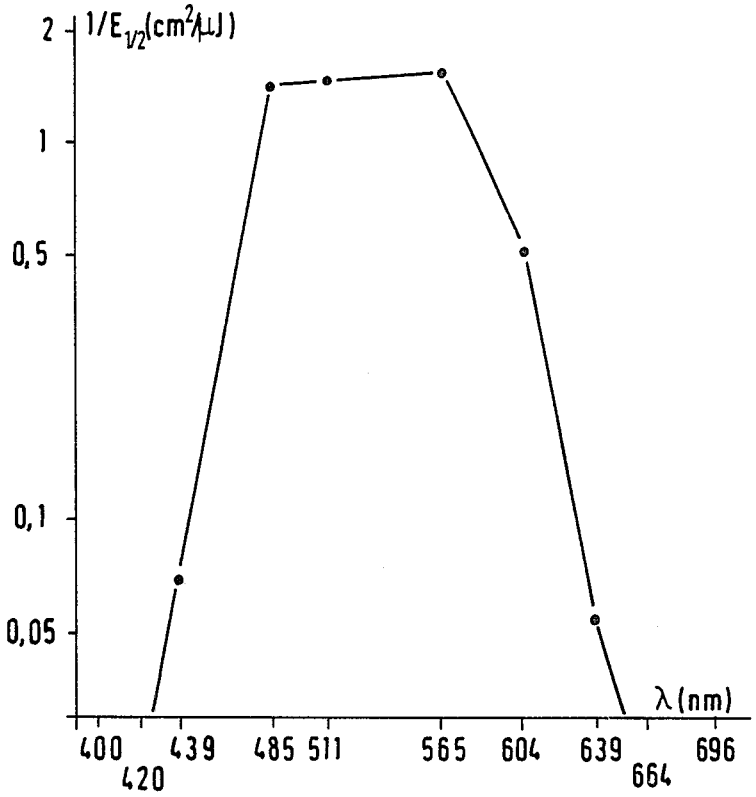
FIGS. 5–7 are graphs depicting the spectrophotosensitivity of recording materials within the present invention which were prepared, respectively, in accordance with Examples 4, 6 and 8 below.

The spectral photosensitivity of the double film (a) is evident from FIG. 5, charging (−) 490 to 520 V.

EXAMPLE 5

A charge-generating film according to Example 1 is coated with a THF solution comprised of 40 parts by weight of polycarbonate and 60 parts by weight of photoconductor compound (A) 1,3-diphenyl-5-(2-chlorophenyl)pyrazoline (formula 1) to a thickness of 10 μm after drying.

In addition, transport films comprising 60 parts by weight of photoconductor compound, 37 parts by weight of polycarbonate (Makrolon 3200) and 3 parts by weight of electron-acceptor compound were deposited, respectively, onto the pigment film to a thickness of approximately 10 μm. As acceptors, the halogenated anthracene derivatives (1) 9-bromoanthracene (MBA), (2) 9,10-dibromoanthracene (DBA) and also (3) 9,10-dichloroanthracene (DCA) were used.

The results of the photosensitivity measurements are summarized in the following table (illumination intensity 3.8–4.7 μW/cm²):

| Photoconductor layer | $(-)U_o/V$ | $E_{\frac{1}{2}}$ | $E_{\frac{1}{8}}$ | $(-)U_E/V$ (after 3 sec) |
|---|---|---|---|---|
| A | 520 | 1.01 | 3.33 | 35 |
| A1 | 480 | 0.88 | 2.09 | 7 |
| A2 | 490 | 0.91 | 2.17 | 7 |
| A3 | 560 | 0.94 | 2.27 | 7 |

In the case of film A (formula 1), the residual discharge behavior in particular could be improved by acceptor additives.

EXAMPLE 6

A pigment preparation, Hacolor No. 50915 (manufactured by Hagedorn, Osnabrueck), containing 70 parts by weight of ε-copper phthalocyanine (C.I. 74160:6) and 30 parts by weight of cellulose nitrate was coated onto polyester film (Al/PET film) which had been coated with aluminum by vapor deposition to a thickness of 310 mg/m$^2$. A solution comprised of 70 parts by weight of styrylpyrazoline derivative (formula 5), 37 parts by weight of polycarbonate and 3 parts by weight of MBA was applied thereto to thicknesses of 11 μm and 14 μm, respectively.

Figure 6:
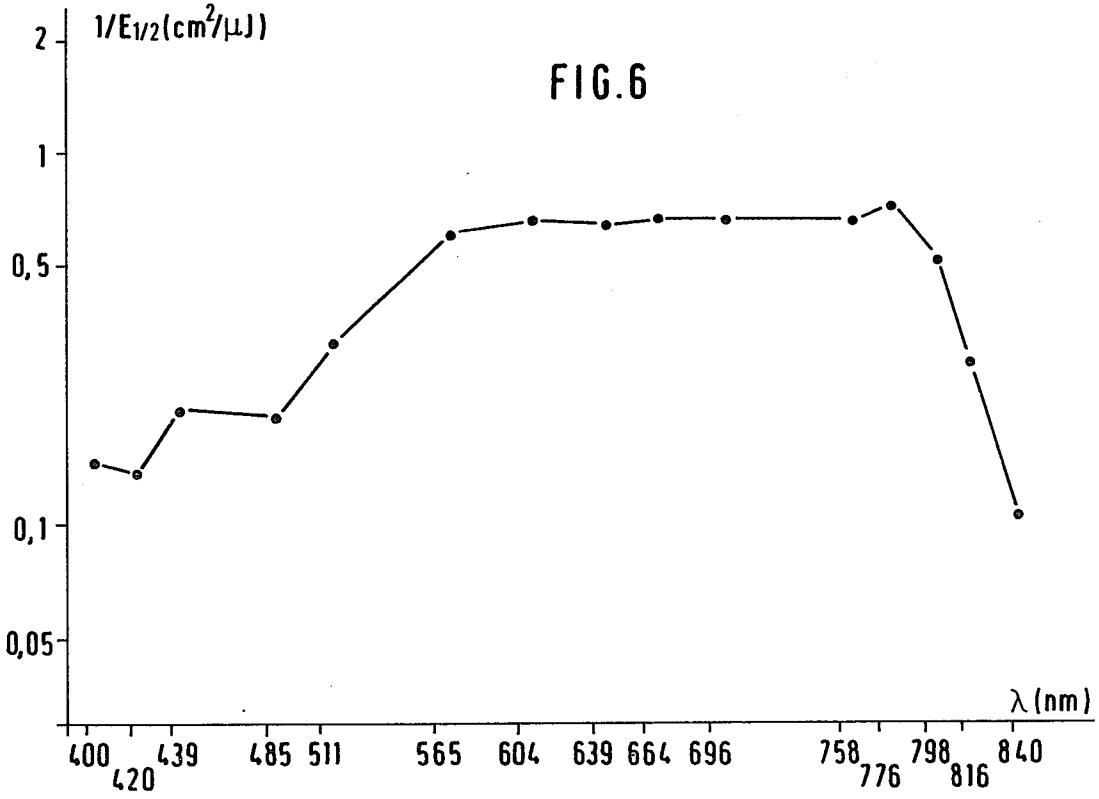

The photosensitivity was determined as in Example 1, and the spectral photosensitivity of the thinner coating was plotted at a charge of about (−) 180 V in FIG. 6.

| Photoconductor layer | $(-)U_o$/V | $E_{\frac{1}{2}}$ (μJ/cm$^2$) |
|---|---|---|
| 11 μm | 180 | 1.48 |
| 14 μm | 280 | 1.73 |

EXAMPLE 7

5 parts by weight of N,N'-dimethylperylimide (formula A) were added to a solution containing 40 parts by weight of formula 5, 50 parts by weight of a copolymer of styrene and maleic acid anhydride (Scripset 550; manufactured by Hoechst AG), and 5 parts by weight of 9-bromoanthracene in tetrahydrofuran, and was then very finely ground in a ball mill for 2.5 hours. The resulting pigment dispersion was then coated onto a superficially wire-brushed aluminum foil to a thickness of approximately 5 μm.

In the same way, mono-disperse films were prepared from 45 parts by weight of the compound formula 5, 50 parts by weight of Scripset 550, and 5 parts by weight of pigment of the following type (2) Hostaperm Orange GR (formula E, transperinone), (3) Hostaperm Scarlet GO (formula G, C.I. 59300), and also (4) N,N'-(nitro-1,2-phenylene)benzothioxane-3,4-carboximide-3-imidine (formula H).

The measurement of the photosensitivity according to Example 1 gave the following half-value energies, with positive and negative charging and an illumination intensity of about 3 μW/cm$^2$:

| Photoconductor layer (layer thickness) | $(-)U_o$/V | $E_{\frac{1}{2}}$ | $(+)U_o$/V | $E_{\frac{1}{2}}$ |
|---|---|---|---|---|
| 1 (5 μm) | 490 | 8.5 | 490 | 10.2 |
| 2 (5 μm) | 500 | 15.7 | 485 | 9.5 |
| 3 (approx. 10 μm) | 525 | 11.5 | 540 | 9.4 |
| 4 (5 μm) | 460 | 9.8 | 470 | 10.2 |

EXAMPLE 8

The pigments (1) Hostaperm Orange GR (formula E, trans-perinone), (2) Hostaperm Scarlet GO (formula G, C.I. 59300), (3) Perylene-3,4,9,10-tetracarboxylic acid bis-benzimidazole (formula D), (4) Novoperm Red TGO2 (formula F, cis-perinone), (5) N,N'-di-n-butylperylimide (formula B), and (6) N,N'-di(3-methoxypropyl)perylimide (formula C), were vapor-deposited in vacuo, at $1.3\times10^{-7}-10^{-8}$ bar and a temperature of <300° C. under mild conditions, onto a Al/PET film very thinly precoated with polycarbonate. The pigment film thicknesses achieved under these circumstances were in the range from 100 to 160 mg/m$^2$.

A solution comprised of 70 parts by weight of formula 5 and 30 parts by weight of vinyl chloride/vinyl copolymer (Hostaflex M 131) was coated onto these films 1–4, and a transport film of the same composition but containing polycarbonate as a binder was deposited onto pigment films 4–6; the thicknesses of the transport films was about 10 μm after drying.

The measurement of the photosensitivity was carried out analogously to Example 1 (illumination intensity 3.8 μW/cm$^2$):

| Photoconductor layer | $(-)U_o$/V | $E_{\frac{1}{2}}$ | $E_{\frac{1}{8}}$ | $(-)U_E$/V (after 3 sec) |
|---|---|---|---|---|
| 1 | 490 | 1.32 | 2.8 | 3 |
| 2 | 510 | 1.66 | 3.74 | 3 |
| 3 | 470 | 0.73 | 1.86 | 0 |
| 4 | 485 | 1.04 | 2.17 | 0 |
| 4' | 460 | 1.09 | 2.69 | 11 |
| 5 | 480 | 1.14 | 2.52 | 11 |
| 6 | 490 | 1.35 | 3.78 | 11 |

Figure 7:
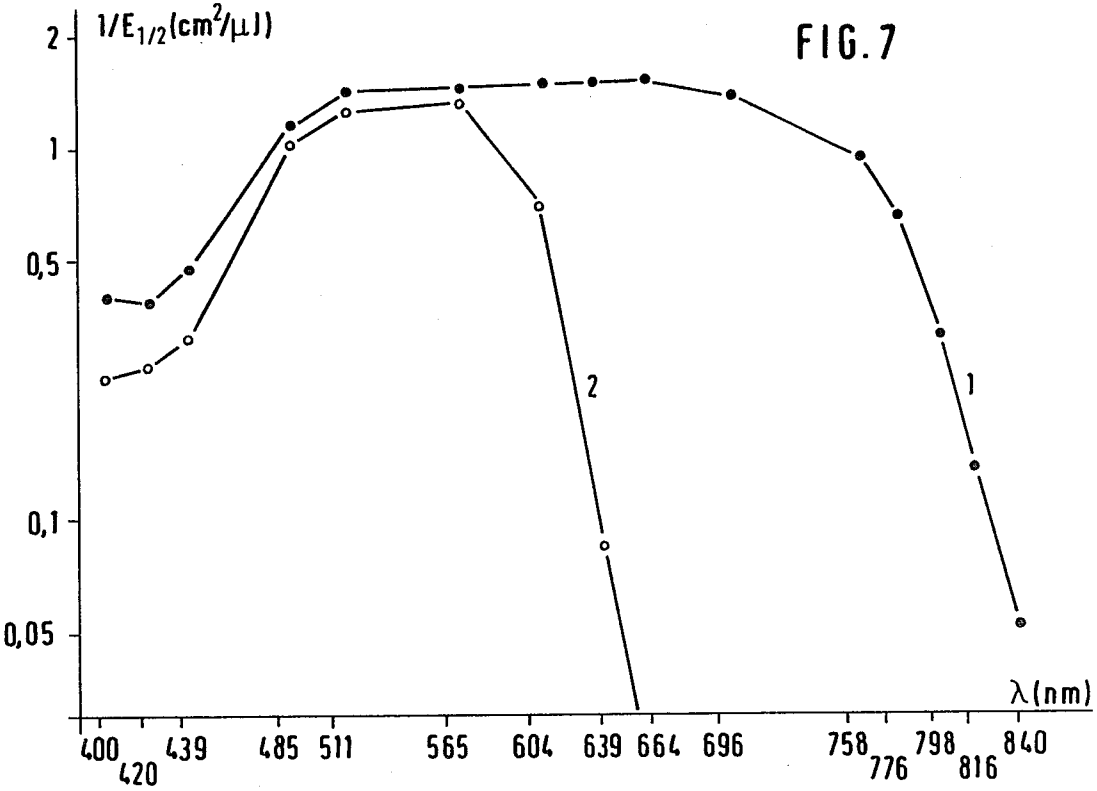

In addition, the spectral photosensitivity of the photoconductive films No. 3 (curve 1) and No. 4 (curve 2), with charging to (−) 480 to 510 V, was measured as in Example 4 (FIG. 7).

EXAMPLE 9

A THF solution containing equal parts by weight of polycarbonate and 1-(4-chlorophenyl)-3-(2-chlorostyryl)-5-(2-chlorophenyl)pyrazoline (formula 7) was coated onto a charge-carrier generation film according to Example 1, to a thickness of approximately 9 μm. Another transport film comprising 50 parts by weight of polycarbonate and 3 parts by weight of 9-bromoanthracene was likewise deposited on the pigment film.

The photosensitivity was measured at an illumination intensity of about 3.7 μW/cm$^2$:

| Photoconductor layer | Acceptor | $(-)U_o$/V | $E_{\frac{1}{2}}$ | $E_{\frac{1}{8}}$ | $(-)U_E$/V (after 3 Sec) |
|---|---|---|---|---|---|
| 1 | — | 480 | 1.29 | 3.61 | 15 |
| 2 | MBA | 490 | 1.11 | 2.9 | 15 |

What is claimed is:

1. An electrophotographic recording material comprised of an electrically conducting film base and at least one photoconductive film provided on said film base, said photoconductive film comprising a binder, a charge-carrier generating compound and a pyrazoline charge-transporting compound represented by the formula

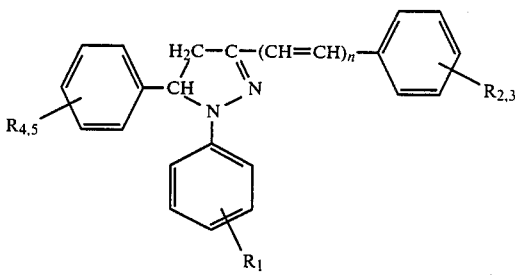

(I)

where n denotes zero or 1, $R_1$ denotes hydrogen, and $R_2$, $R_3$, $R_4$ and $R_5$ respectively denote hydrogen or halogen, where at least one of $R_4$ and $R_5$ is a halogen and where, when n=1, at least one of $R_2$ and $R_3$ denotes a halogen.

2. A recording material as claimed in claim 1, wherein said halogen is either a chlorine or bromine.

3. A recording material as claimed in claim 2, wherein said charge-transporting compound is 1-phenyl-3-(2-chlorostyryl)-5-(2-chlorophenyl)-pyrazoline or 1-phenyl-3-(2,4-dichlorostyryl)-5-(2,4-dichlorophenyl)-pyrazoline.

4. A recording material as claimed in claim 2, wherein the charge-transporting compound is 1,3-diphenyl-5-(2-chlorophenyl)pyrazoline 1,3-diphenyl-5-(2,4-dichlorophenyl)pyrazoline.

5. A recording material as claimed in claim 1, wherein said photoconductive film is comprised of a charge-generating layer and a charge-transport layer.

6. A recording material as claimed in claim 1, further comprising an adhesion-promoting, insulating intermediate layer between said film base and said photoconductive film.

7. A recording material as claimed in claim 1, wherein said binder of said photoconductive film comprises at least one from the group consisting of a polyester resin, a vinyl chloride/vinyl acetate copolymer and a polycarbonate.

8. A recording material as claimed in claim 1, wherein said photoconductive film contains an alkaline-decoatable binder.

9. A recording material as claimed in claim 8, wherein said alkaline-decoatable binder is selected from the group consisting of a styrene/maleic acid anhydride copolymer, a sulfonylurethane, a phenolic resin, and a copolymer of vinyl acetate with an unsaturated carboxylic acid.

10. A recording material as claimed in claim 1, wherein said photoconductive film contains a charge-carrier generating pigment.

11. A recording material as claimed in claim 10, wherein said pigment comprises a condensation product of perylene-3,4,9,10-tetracarboxylic acid dianhydride with alkylamines, arylamines, aralkylamines or o-aryldiamines.

12. A recording material as claimed in claim 10, wherein said pigment comprises a metal-containing or metal-free phthalocyanine.

13. A recording material as claimed in claim 1, wherein said photoconductive film contains an electron-acceptor compound.

14. A recording material as claimed in claim 13, wherein said electron-acceptor compound comprises an anthracene or acridine derivative which is halogenated in the 9- or 10-position.

15. A recording material as claimed in claim 1, wherein at least one of $R_2$, $R_3$, $R_4$ and $R_5$ is a halogen and said halogen is attached to an ortho carbon of a phenyl moiety in formula (I).

* * * * *